US010151534B2

(12) United States Patent
Epps

(10) Patent No.: US 10,151,534 B2
(45) Date of Patent: Dec. 11, 2018

(54) METHOD FOR SLAG REMOVAL DURING METAL PROCESSING

(71) Applicant: Larry J Epps, Butler, PA (US)

(72) Inventor: Larry J Epps, Butler, PA (US)

( * ) Notice: Subject to any disclaimer, the term of this patent is extended or adjusted under 35 U.S.C. 154(b) by 225 days.

(21) Appl. No.: 15/148,175

(22) Filed: May 6, 2016

(65) Prior Publication Data

US 2016/0334166 A1 Nov. 17, 2016

Related U.S. Application Data

(60) Provisional application No. 62/161,328, filed on May 14, 2015.

(51) Int. Cl.
*F27D 25/00* (2010.01)
*C21B 7/14* (2006.01)
*F27D 3/15* (2006.01)

(52) U.S. Cl.
CPC ..... *F27D 3/1581* (2013.01); *F27D 3/1563* (2013.01); *C21B 7/14* (2013.01)

(58) Field of Classification Search
CPC ..... C21B 7/14; C21C 7/072; C21C 5/4606; C21C 5/4613; C21C 7/0037; C21C 7/0075; C21C 7/064; F27D 2003/169; F27D 3/1563; F27D 3/1581; F27D 3/16; F27D 2027/002; F27D 27/00; F27D 3/0033
USPC ..... 266/44, 227, 228, 238, 143, 165, 276, 266/161
See application file for complete search history.

(56) References Cited

U.S. PATENT DOCUMENTS 3,659,833 A * 5/1972 Grant ..... F27D 3/1563 266/228
3,883,124 A * 5/1975 Galer ..... B22D 41/001 266/228
5,015,291 A 5/1991 Skach et al.
5,336,293 A 8/1994 Freissmuth et al.
5,360,204 A * 11/1994 Mancuso ..... F27D 3/1563 266/226

(Continued)

FOREIGN PATENT DOCUMENTS

CN 201102972 Y 8/2008
GB 1018164 A 1/1966

(Continued)

OTHER PUBLICATIONS

Davene et al., WO 2006016202, Metallurgical reactor deslagging blade, Feb. 16, 2006, 6 pages.*

(Continued)

*Primary Examiner* — Scott R Kastler
*Assistant Examiner* — Michael Aboagye
(74) *Attorney, Agent, or Firm* — Karen Tang-Wai Sutton

(57) ABSTRACT

A method (110) for removing a quantity of slag (24) from hot metal (6) in a ladle (2) during a process of metal purification such as steelmaking using an improved skimmer paddle (100) having a system of internal piping (60) that at one end is attached to a source of gas and at a second end terminates into one or more ports (64). The improved skimmer (100) is moved along a top surface (6*a*) of the hot metal, though the quantity of slag, and predetermined flows of gas are forced into the piping system and expelled through the port or ports (64) to move the quantity of slag out from the back of ladle to be skimmed into a slag pot (4) to remove undesired impurities from the hot metal.

9 Claims, 7 Drawing Sheets

(56) References Cited

U.S. PATENT DOCUMENTS 5,972,072 A 10/1999 Kinsman et al.

FOREIGN PATENT DOCUMENTS

| | | | | | |
|---|---|---|---|---|---|
| KR | 2006/0074986 | A | | 7/2006 | |
| KR | 20060074986 | | * | 7/2006 | ..... F27D 3/1581 |
| KR | 101311233 | B1 | | 9/2013 | |
| WO | WO 2006016202 | | * | 2/2006 | ..... F27D 3/1581 |

OTHER PUBLICATIONS

Hwan, KR 20060074986, Skimmer paddle recoverable valuable metal from slag, Jul. 4, 2006, 5 pages.*

* cited by examiner

METHOD FOR SLAG REMOVAL DURING METAL PROCESSING

CROSS REFERENCE TO RELATED APPLICATIONS

Reference is made to and priority claimed from U.S. provisional application Ser. No. 62/161,328 filed on May 14, 2015.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION BY REFERENCE OF MATERIAL SUBMITTED ON A COMPACT DISC OR AS A TEXT FILE VIA THE EFS WEB SYSTEM

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention pertains to the field of steelmaking. More particularly, the present invention pertains to an improved method of using an improved skimmer paddle for separating slag from a quantity of desired molten metal during the steelmaking process.

Background Art

The present invention relates to the removal of slag from the surface of a quantity of molten metal after the metal has been treated in a ladle. Efficient removal of slag reduces production costs, and improves yield and steel quality. Slag is a waste product formed during the steelmaking process that separates and floats to the surface of the molten metal, where it can be removed by skimming the surface of the molten metal, to scrape the slag off into a slag pot or other waste collection container. Under normal circumstances, when skimming, a small portion of the slag will be inaccessible to the skimmer paddle and scattered along the surface of the molten metal. Consequently the remaining slag will be very difficult to remove. The most popular method for moving the slag into a position where it can be skimmed from the ladle is by installing a bubbling system. Typically, the bubbling system consists of a motor driven "bubbler", a refractory encased pipe "bubbling lance" (i.e. a pipe encased in a heat-resistant material) inserted into the hot metal in the back portion of the ladle. The refractory coating on the bubbler pipe keeps the pipe from melting due to the temperature of the hot metal. Gas is injected through the pipe and into the hot metal causing turbulence, which tends to push the remaining slag away from the back of the ladle and gather into a position where the skimming paddle can reach it. At this point the skimmer paddle, a hoe-type apparatus, can reach the re-positioned slag and skim it off of the surface of the hot metal and into the slag pot.

The prior art describes an apparatus for efficient slag removal using a paddle and a separate bubbling system in U.S. Pat. No. 5,360,204 (Mancuso). While highly effective, the Mancuso bubbling system requires a motorized hoist to raise and lower the pipe as well as the devices required to start and stop gas flow. The hoist arm in particular is expensive and many steelmakers balk at the extra cost of this permanent equipment. Additionally, the system described in Mancuso requires additional space around the skimming area which in many instances may not be readily available, thus limiting the applicability of the Mancuso system.

The bubbler pipe and the skimming paddle are both consumables used during the steelmaking process, requiring regular replacement as they become damaged by repeated exposures to the hot molten metal. Thus having both a bubbler and a paddle increases production costs, further deterring steelmakers from investing in the bubbler system, despite increased yield and efficiency in slag removal. Steelmaking is a highly competitive industry, and unfortunately better systems such as Mancuso's are unattractive due to increased cost and space requirement. Thus many steelmaking mills lack a bubbler system, and rely only on the skimming process despite being less efficient. Skimmers are mainly used in the process of making iron, but can be utilized for other skimming processes involving molten metal.

What is needed is an improved skimmer that removes slag more efficiently and improves yield, all at a lower the cost for steelmakers as well as requiring no additional space.

What is also needed is an improved method of removing slag using the improved skimmer.

BRIEF SUMMARY OF THE INVENTION

An improved method of removing a quantity of slag floating on a surface of a quantity of hot metal by an improved skimmer having a piping system through which predetermined gas flows are expelled out of the piping system through at least one port and into the ladle, the quantity of slag skimmed out of the ladle and into a slag pot.

In a first aspect of the improved method, a first skimming cycle beings with the improved skimmer is positioned over the ladle and the port located above the surface of the hot metal, where a low flow of gas is introduced into the piping system and expelled out the port into the ladle, the emitted gas moving the quantity of slag towards a spout of the ladle to be skimmed into the slag pot by the improved skimmer. A heaviest quantity of slag is removed, and the process repeated until the quantity of slag remaining on the surfaced of the hot metal is liquid or small and chunky.

In a second aspect of the improved method, after the first skimming process is complete, the improved skimmer is positioned towards a back wall of the ladle and lowered so as to position the port into one of three positions: (1) into the quantity of slag floating on the surface of the hot metal, (2) no more than three inches below the surface of the hot metal, and (3) more than three inches below the surface of the hot metal, and initiating a high gas flow for a predetermined amount of time through the piping system and out the port. The gas emitted moves the quantity of slag towards the spout and the improved skimmer skimming the quantity of slag into the slag pot. The process is repeated until the surface of the hot metal is slag free.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
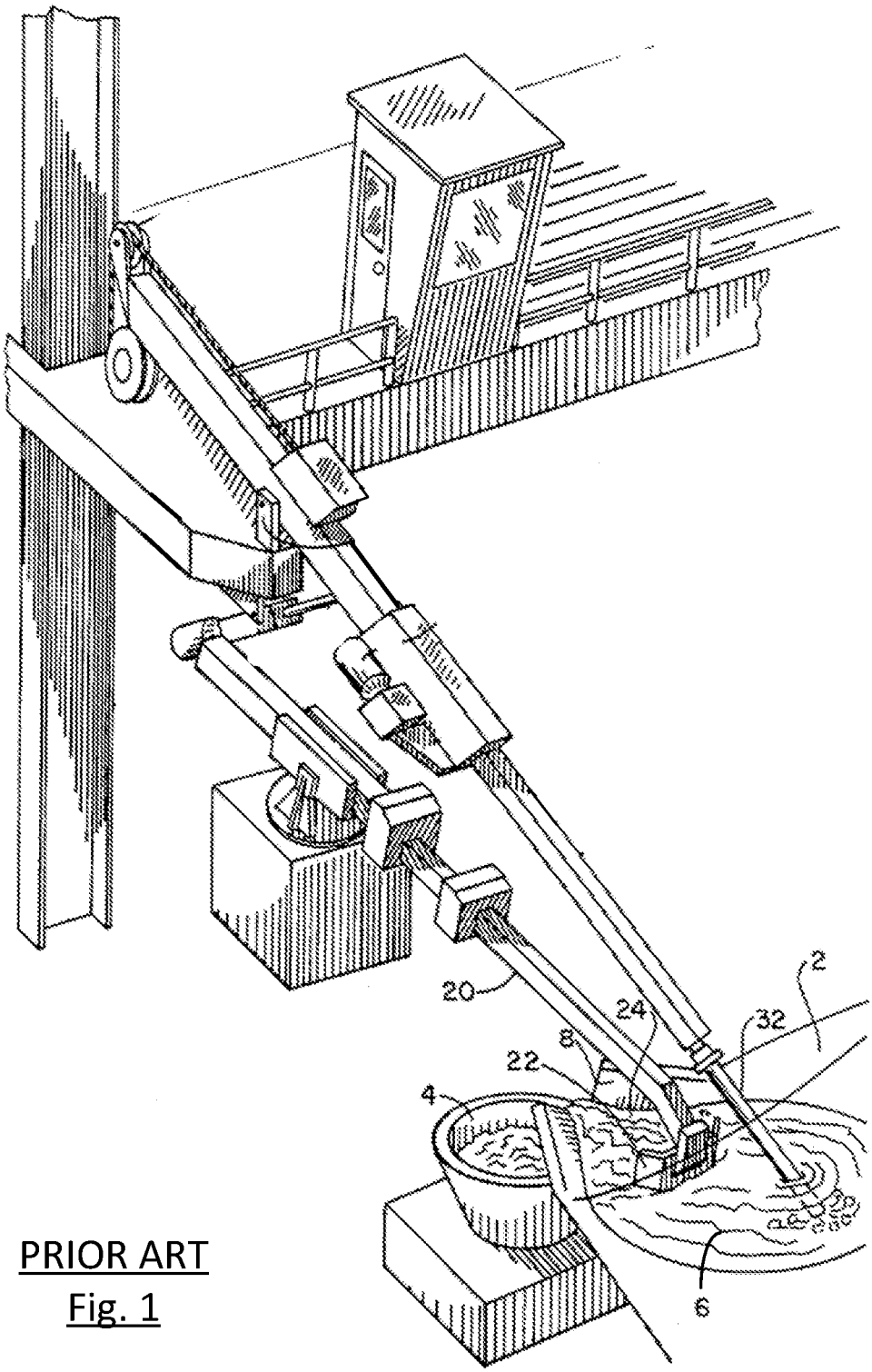
PRIOR ART Fig. 1
FIG. 1 describes a PRIOR ART apparatus for removing slag, using a bubbling apparatus and a separate skimming apparatus. The patent for the Bubbler issued in 1984 to Matthew Mancuso and was first assigned to the Kiebler Thompson Corporation, which was subsequently bought out by Louis A. Grant. Inc. A bubbling lance or bubbler 32 is referred to as a ladle bubbler system. The unit located below the bubbler 32 is a skimming machine 20. A skimming paddle 22 is located on an end of the skimming machine. A ladle 2 contains a quantity of molten metal, heretofore referred to as "hot metal". A slag pot 4 receives and holds a quantity of slag 24 skimmed off a surface of the hot metal.
Figure 2:
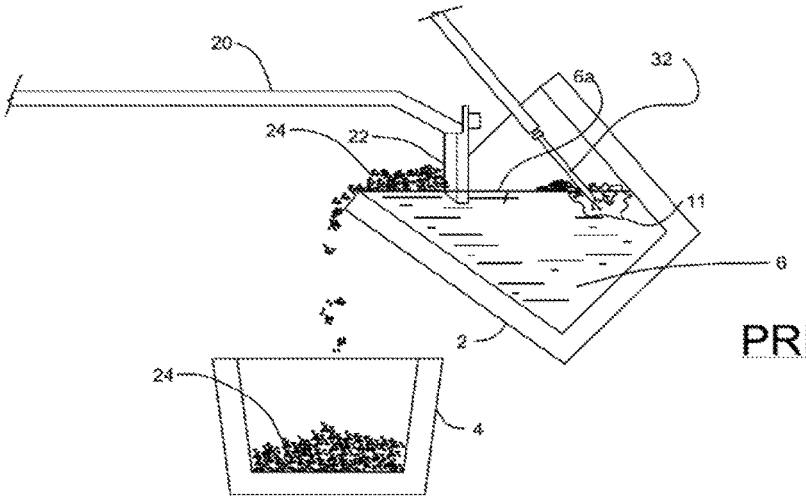
PRIOR ART Fig. 2
FIG. 2 describes a PRIOR ART method for using the apparatus of FIG. 1. Before using the bubbler 32, the ladle 2 is tilted as shown and an operator skims as much of the slag 24 as possible from the surface of the hot metal. The slag 24 is pulled towards a ladle spout 8. Once the slag 24 that is accessible to the skimming paddle 22 has been skimmed off into the slag pot 4, the bubbler lance 32 is inserted into the hot metal towards the back of the ladle 2 and injection of stirring gas begins. Turbulence caused by the stirring gas moves the slag 24 away from the back of the ladle 2 and into an area where it is accessible to the skimming paddle 22. At this time the skimming paddle 22 is able to skim the last of the slag 24 from the hot metal and into the slag pot 4, and minimizes the amount of hot metal accidentally skimmed into the slag pot 4 with the slag 24.
Figure 3:
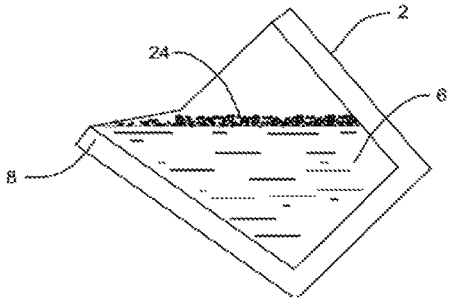
PRIOR ART Fig. 3
FIG. 3 describes the PRIOR ART method and apparatus of FIGS. 1 and 2 in a side elevation view of the ladle 2, showing the slag 24 floating on the surface of the hot metal. The ladle spout 8 is shown towards the left side of the drawing.
Figure 4:
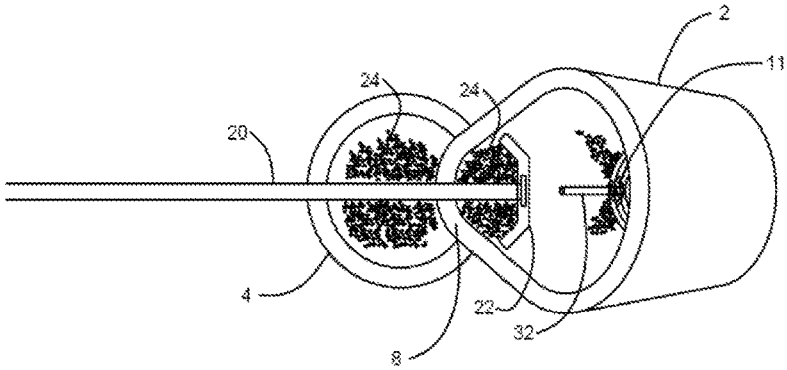
PRIOR ART Fig. 4
FIG. 4 describes the PRIOR ART method and apparatus of FIGS. 1-3 in a plan view showing the ladle 2, and the slag pot 4 with the skimming machine 20 and the bubbler 32 in operation. Also shown is the slag 24 floating on the surface of the hot metal.

The following is a list of reference labels used in the drawings to label components of different embodiments of the invention, and the names of the indicated components.

2 ladle
4 slag pot
6 quantity of hot metal or molten metal
6*a* top surface or surface of hot metal
8 ladle spout
11 gas bubbles
20 skimming machine boom or arm
22 skimming paddle
24 slag
32 bubbler or bubbler lance
50 front wall or front face
52 first side wall
54 second side wall
56 refractory coating
58 framework or support structure
60 piping system
62 internal piping
64 port
66 gas fitting
68 hose reel (connects to gas supply)
70 high temperature hose
100 improved skimmer paddle
110 method of removing slag using an improved skimmer
120 initiate low flow gas
122 tilt ladle until molten metal appears
124 position skimmer over ladle
126 skim slag into slag pot
128 when heaviest slag has been removed from the ladle
130 liquid and small chunky slag remains
132 place skimmer paddle toward back wall of ladle
134 lower skimmer paddle into the molten metal
136 initiate high flow gas
138 slag moves towards spout
140 skim remaining slag until surface is clean
142 park skimmer paddle
144 determine if slag pot is full
146 replace full slag pot with empty pot

GLOSSARY OF IMPORTANT TERMS

High flow of gas: 100-500 SCFM

Hot metal or molten metal: metal heated to a temperature such that the metal is in a liquid state, and includes metals commonly purified in a ladle such as steel and iron Improved skimmer or skimmer paddle or apparatus: an apparatus having combined bubbler and skimmer paddle features in a single contained unit Low flow of gas: 10-400 SCFM Surface of hot metal or hot metal surface: uppermost or top surface of a quantity of metal.

DETAILED DESCRIPTION

An improved skimmer 100 is shown in FIGS. 5*a-d*, and an improved method 110 of removing slag using the improved skimmer is shown in FIGS. 6-11. Turning to the Figures, the improved skimmer 100 is a skimmer paddle comprised of a plate of steel approximately three quarters to one inch in thickness, disposed as a welded steel framework 58 coated in reinforced refractory 56. The steel thickness and refractory coating 56 are required to keep the improved skimmer 100 from melting into the hot metal 6 while the skimming process is underway. A prior art paddle 22 is typically ¾ inch thick. The weight of the welded framework 58 and refractory coating 56 is comparable to the weight of the steel plate originally used for the prior art paddle 22, and thus a (prior art) skimming machine can support the weight of the improved skimmer while moving back and forth and side to side while skimming, despite the extra thickness. This is important, as it means existing equipment can be used with the improved skimmer 100.

The welded framework 58 of the improved skimmer 100 is typically disposed with a flattened front wall or front face 50 having two ends, a first end having a first side wall 52 and an opposed end having a second side wall 54, the first and second side walls angled at approximately 45 degrees from the vertical away from the front wall 50 to create a multi-faceted paddle that in a front view (FIG. 5*b*), the three walls comprised of the front face 50 and the first and second side walls 52 54 as a whole resemble a portion of a convex octagon. In some other embodiments (not shown) the front wall and the side walls are disposed as a smooth convex paddle when viewed in a front view.

A piping system 60 having internal piping 62 is included within the refractory enclosing the welded framework, the piping 62 having a gas connection fitting 66 at one end through which a source of gas is introduced via a gas line 70 and a hose reel 68 attached to a source of gas (not shown) and at another end, the piping 62 terminating in a series of ports 64 formed in the front wall 50 and the side walls 52 54.

Figure 5A:
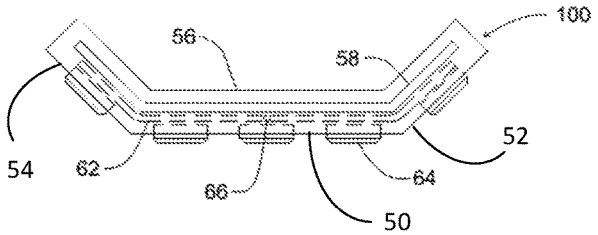
FIG. 5*a* is a top view of an improved skimmer according to the invention, shown in a first embodiment.
Figure 5B:
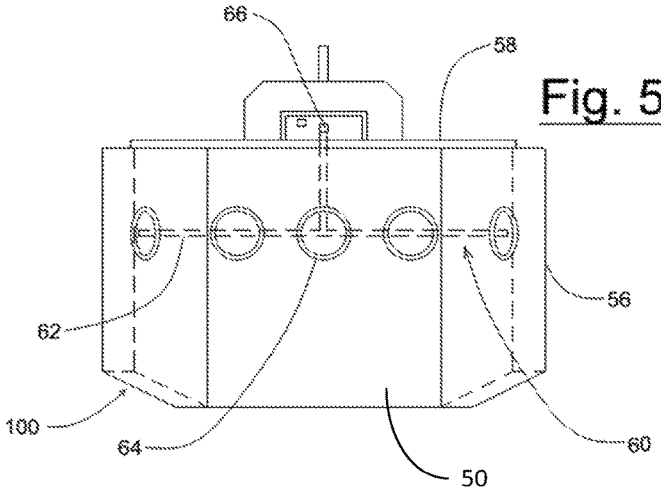
FIG. 5*b* is a front view of the improved skimmer according to the invention, shown in a first embodiment having gas ports on a front face and on a first and second side walls.
Figure 5C:
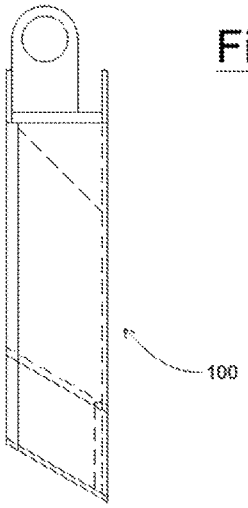
FIG. 5*c* is a side elevation view of the improved skimmer according to the invention, shown in a second embodiment having gas ports on the front face only and lacking ports on the first and second side walls.
Figure 5D:
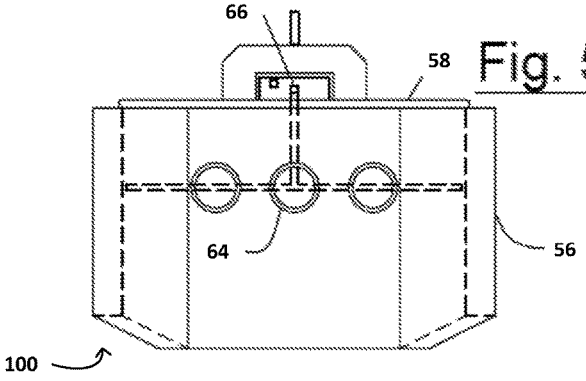
FIG. 5*d* is a second front view of the improved skimmer according to the invention, shown in the second embodiment having the gas ports on the front face of the improved skimmer and lacking ports on the first and second side walls.
Figure 6:
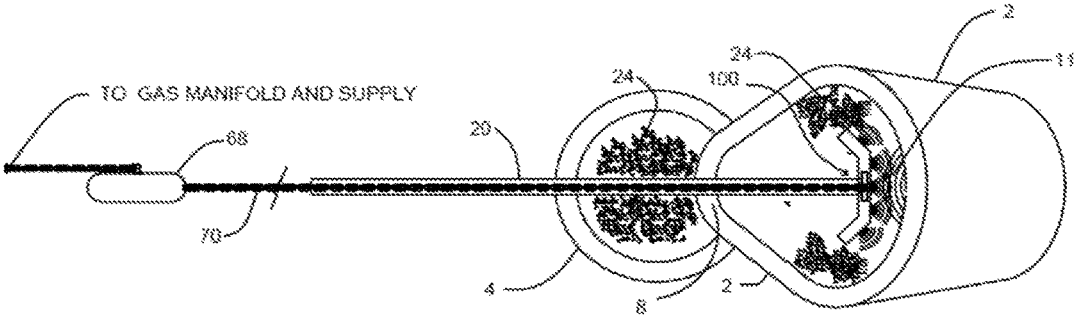
FIG. 6 is a top view of the improved skimmer according to the invention, shown in the first embodiment, as installed with a short connection to the prior art skimming machine boom 20, and shown practicing a method of removing slag.
Figure 7:
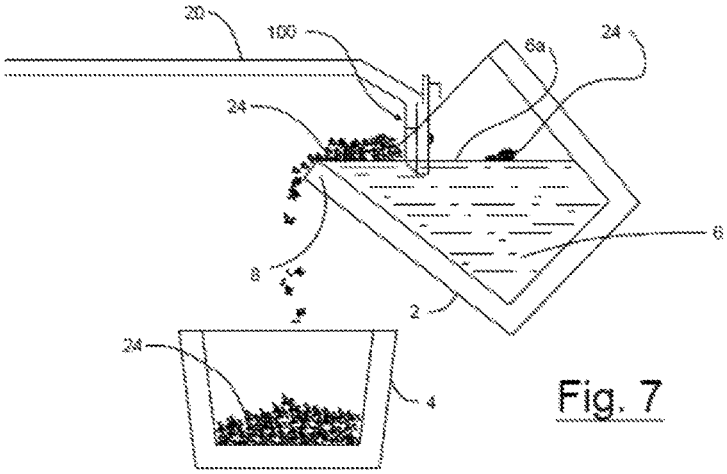
FIG. 7 is a side elevation view, shown in cross section, of the slag pot 4, ladle 2 and the improved skimmer, as installed with a long connection to the prior art skimming machine boom, where the ports of the improved skimmer are above a surface of the hot metal.

The ports 64 are positioned on the front face and on the first and second side walls in a first embodiment, shown in FIGS. 5*a-b*, and in a second embodiment, shown in FIG. 5*c-d*, the ports 64 are positioned on the front face only. Ports 64 are gas-permeable structures, including porous plugs, nozzles, and pipes formed into the front face and in the first embodiment, side walls of the improved skimmer, and can be as simple as through-bores or more complex such as through-bores fitted with gas permeable plugs such as porous plugs or nozzles to prevent the hot metal from entering the ports and clogging them. In both first and second embodiments, the ports 64 are positioned so as to be generally in a one third uppermost portion of the welded framework of the improved skimmer 100. During a first skimming process (FIGS. 6-8, 11) the ports 64 are located above a surface of the hot metal 6*a*, and are purged with a low flow of gas, to prevent the hot metal from flowing into and plugging the ports 64 during the skimming process.

Figure 11:
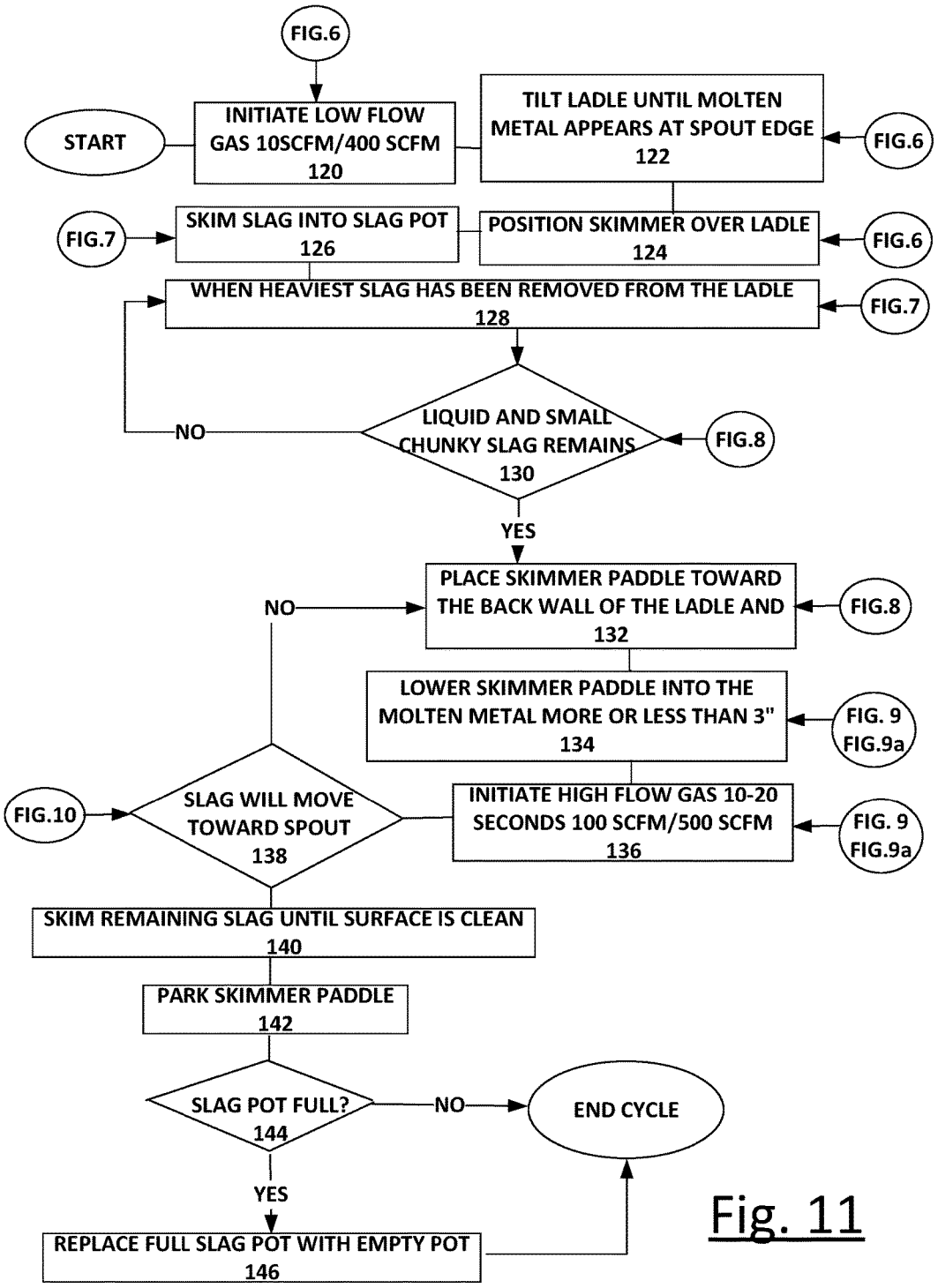
FIG. 11 is a diagrammatic representation of the method for using the improved skimmer described in FIGS. 1-5*d*.

The method of using the improved skimmer 110 is described in flow diagram labelled FIG. 11, as well as in the top and elevation views in FIGS. 6-10. To remove slag from hot metal, the first skimming process begins by an operator initiating the low flow of gas 120, ranging between 10-400 SCFM into the piping system. The ladle is tilted 122 until the hot metal 6 appears at an edge of the spout. The operator positions 124 the improved skimmer over the ladle and then using the improved skimmer, skims 126 slag into the slag pot. When the heaviest slag has been removed 128 from the ladle, the operator observes the ladle contents. If liquid and small chunky slag remains 130, a second skimming process is initiated, where the improved skimmer is placed 132 towards the back wall of the ladle and then lowered 134 into the hot metal either less than 3 inches from the top surface 6*a* or more than 3 inches from the top surface 6*a*, as desired by the operator. High flow gas is initiated 136 for about 10-20 seconds, ranging from 100-500 SCFM. Slag is moved 138 towards the spout and then skimmed 140 into the slag pot. If any slag remains, the process 132 134 136 138 140 is repeated until the surface of the hot metal 6*a* is free of slag. The improved skimmer is then parked 142 and the slag pot inspected 144 for fullness. If full, the slag pot is replaced 146 with an empty pot and the skimming cycle ends. If the slag pot is not full, the skimming cycles end and the pot remains waiting for the next skimming cycle.

It should be noted that whether low flow or high flow gas is expelled, gas bubbles 11 form in the quantity of slag 24 and help consolidate and move the slag 24 towards the spout 8, where the improved skimmer can then skim the slag layer into the slag pot 4. The internal piping system 60 and gas expelled through the piping replaces the prior art bubbler 32 and causes a ripple effect on the surface of the hot metal 6*a* to move the quantity of slag 24 to a position where it can be skimmed off of the surface of the hot metal 6*a*. The prior art bubble system (shown in FIG. 1 as the Mancuso patent) is thus not required to move the quantity of slag 24. The inventor specifically notes that Mancuso teaches at column 3 lines 21-23 that an end of the bubbler lance 32 through which gas is expelled is ideally immersed 3 to 20 inches below the surface of the hot metal 6*a*, and in fact into the quantity of hot metal 6 itself in order to properly move the quantity of slag 24.

Figure 8:
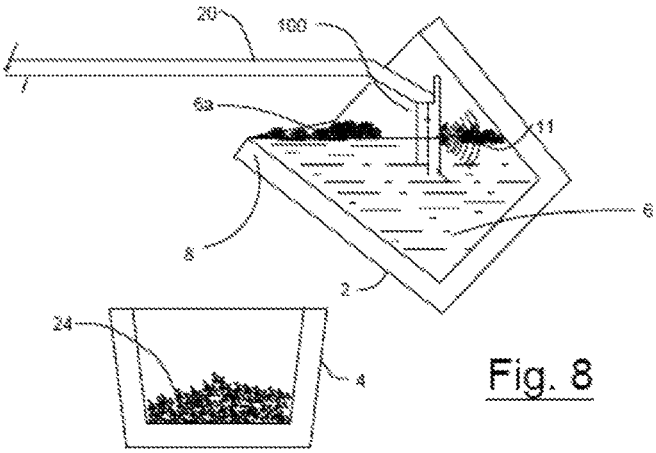
FIG. 8 is a side elevation view, shown in cross section, of the slag pot 4, ladle 2 and the improved skimmer according to the invention, as installed with the long connection to the prior art skimming machine boom, shown with the port located in a slag layer floating on the surface of the hot metal.
Figures 9, 9A:
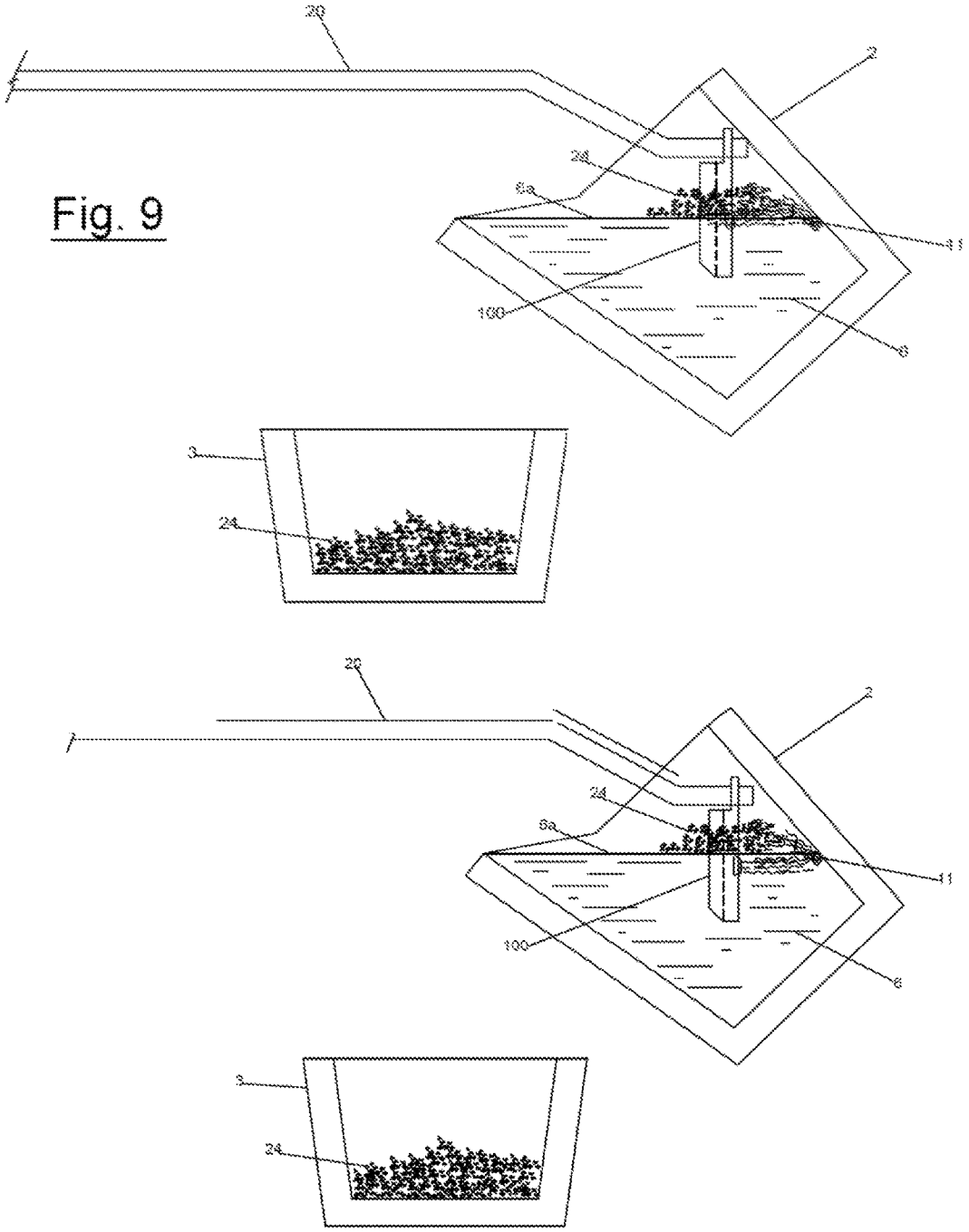
FIG. 9 is a side elevation view, shown in cross section, of the slag pot 4, ladle 2, and the improved skimmer, as installed with the long connection to the prior art skimming machine boom, shown with the port less than 3 inches below the surface of the hot metal.
FIG. 9*a* is a side elevation view, shown in cross section, of the slag pot 4, ladle 2 and the improved skimmer, as installed with the long connection to the prior art skimming machine boom, shown with the port more than 3 inches below the surfaced of the hot metal.
Figure 10:
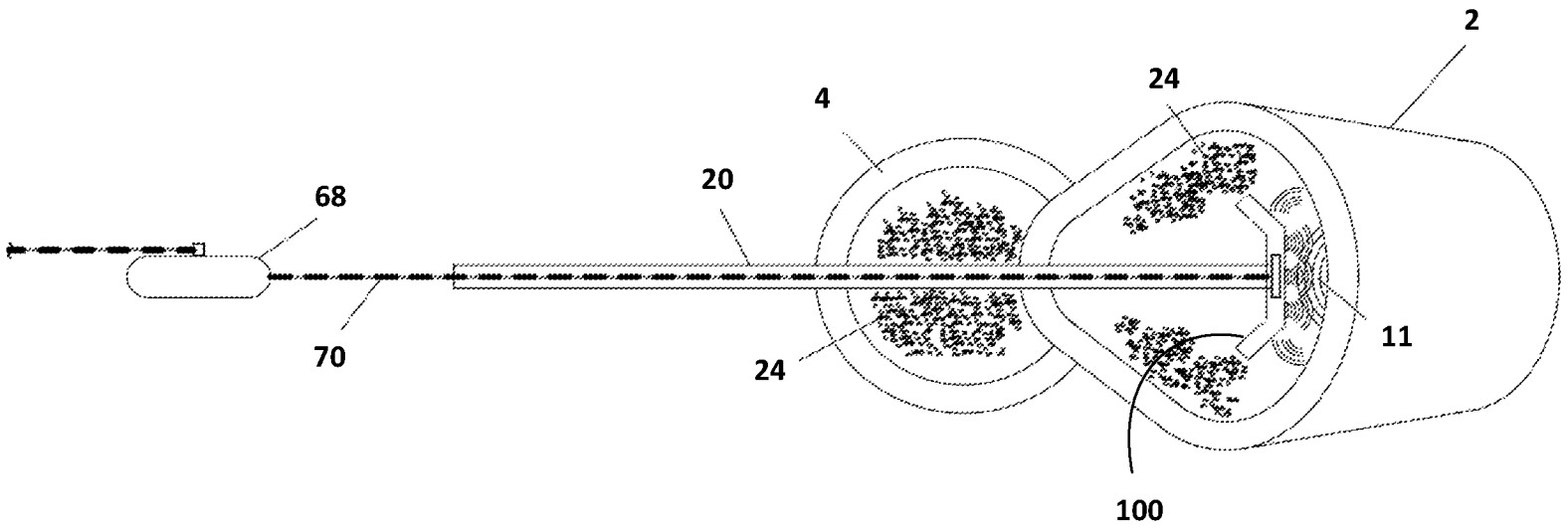
FIG. 10 is a top view of the improved skimmer, as installed with the long connection to the prior art skimming machine boom, and shown in the second embodiment having gas ports on the front face of the skimmer, shown removing slag from the surface of the hot metal.

The improved skimmer 100 and method 110 for slag removal as described herein moves the quantity of slag 24 without using the prior art bubbler 32 apparatus, in three distinct ways: (1) by forcing gas across a top surface 6*a* of the hot or molten metal (FIG. 7), (2) by forcing gas less than 3 inches below the top surface of the molten metal (FIG. 9) and (3) by forcing gas directly into the quantity of slag itself rather than into the hot metal (FIG. 8). The operator of the improved skimmer, by positioning the ports above the surface of the hot metal, into the slag layer itself, or below the top surface of the hot metal, can thus control how skimming is performed, and therefore choose the most efficient way or ways to remove slag using the improved skimmer. The inventor's method of slag removal using his improved skimmer differs vastly from the method taught by the prior art, which is to introduce gas several inches below the hot metal surface 6*a* for efficient slag movement and removal.

FIG. 11 continues to describe a second skimming process, which is an optional process used only when the operator determines that the first skimming process 120 122 124 126 128 is unable to extract a relatively small amount of slag remaining in the ladle, with this second skimming process typically performed at an end of the entire slag removal process. During the second skimming process, the improved skimmer is plunged 134 less than three inches below the surface of the hot metal (FIG. 9) or more than three inches below the surface of the hot metal (FIG. 9*a*) such that the ports 64 are submerged in the hot metal 6, and the higher flow gas is expelled through the piping system 60, as needed. The second skimming process is also typically used in conjunction with the first skimming process when the quantity of slag 24 in the ladle is in a liquid state, and the bubbling gas 11 helps push the slag to the surface of the hot metal 6*a* for removal.

As previously stated, the weight of the welded steel frame and the refractory will be comparable in weight to the prior art skimming paddle 22 constructed from steel plate. Therefore, no major structural modifications to the operator's existing prior art skimmer machine are necessary. Easy modifications, however, are required in order to use the improved skimmer 100. First, a hose reel 68 with a high temperature hose 70 must be installed on or through the skimming machine. The hose reel 68 and the high temperature hose 70 are necessary to conduct the gas from a gas manifold (not shown) to the piping system 60 embedded within the refractory material. In addition, a quick disconnect and short section of flexible hose will be required to be installed between the skimming machine and the improved skimmer 100. The aforementioned manifold is comprised of regulators and electrically operated valves to control the purge gas as well as the higher velocity gas required to move the quantity of slag 24 away from the back of the ladle 2. Manual and automatic controls will be provided for maintenance purposes as well as for operation by the operator's automation system.

The inventor notes that the improved skimmer and method for using the improved skimmer allow for significant cost reductions and efficiency/quality increases for the mill owner. Steelmaking efficiency is improved without incurring the additional capital equipment cost required by the prior art Mancuso bubbling system, since existing skimming equipment can be used with minor and easy modifications. Since both the bubbler and the skimmer are consumables requiring regular replacement, the improved skimmer and method furnish additional savings to the mill owner, who now neither needs to purchase nor stock an additional consumable item (the bubbler). Additionally, use of the improved skimmer and method for using the improved skimmer increases steel quality, by removing more of the slag impurities, such as sulfur, from the molten metal, and thus reducing reversion of these impurities back into the molten metal.

It is to be understood that the above-described arrangements are only illustrative of the application of the principles of the present invention. Numerous modifications and alternative arrangements may be devised by those skilled in the art without departing from the scope of the present invention.

What is claimed is:

1. A method (110) of removing a quantity of slag (24), the quantity of slag comprised of a quantity of heaviest slag and a quantity of remaining slag in at least one of a liquid or small and chunky state floating on a surface (6*a*) of a quantity of hot metal (6) in a ladle (2) having a spout (8) and into a slag pot (4) using a skimmer (100) having a convex-shaped steel framework with a front face formed with at least one port disposed as a gas permeable structure, a piping system housed inside the framework having a gas output end terminating at the at least one port, and a reinforced refractory coating formed over the steel framework, the method (110) comprising:

introducing (120) a first predetermined flow of gas into the piping system (60) and expelling the gas out through the at least one port;

positioning (124) the skimmer over the ladle; and skimming (126) the quantity of heaviest slag into the slag pot:

wherein the gas expelled through the at least one port is directed away from the front face (50) and away from the spout (8).

2. The method of claim 1, further comprising the following steps of:

assessing (128) whether the quantity of remaining slag in the ladle after the heaviest slag has been removed is in at least one of a liquid or small and chunky state;

placing (132) the skimmer into the ladle towards a back wall of the ladle if liquid or small and chunky slag remains in the ladle;

lowering (134) the skimmer into the hot metal;

introducing (136) a second predetermined flow of gas into the piping system and expelling the gas out through the at least one port;

moving (138) the quantity of slag towards the spout; and skimming (140) the quantity of slag into the slag pot until the quantity of slag is removed from the ladle, after skimming (126) the quantity of heaviest slag into the slag pot.

3. The method of claim 2, wherein the first predetermined flow of gas is a low flow of gas as compared to the second predetermined flow of gas.

4. The method of claim 3, wherein the first predetermined flow of gas is in a range of 10-400 SCFM.

5. The method of claim 3, wherein the second predetermined flow of gas is in a range of 100-500 SCFM.

6. The method of claim 1, wherein during positioning (124) the skimmer above the ladle, the at least one port (64)) is positioned in the quantity of slag floating on the surface (6*a*) of the hot metal.

7. The method of claim 2, wherein during the step of lowering (134) the skimmer into the hot metal, the at least one port (64) is positioned less than three inches below the surface of the hot metal in the ladle.

8. The method of claim 2, wherein during the step of lowering (134) the skimmer into the hot metal, the at least one port (64) is positioned more than three inches below the surface (6*a*) of the hot metal.

9. The method of claim 1, wherein during positioning (124) the skimmer above the ladle, the at least one port (64) is positioned above the surface (6*a*) of the hot metal.

* * * * *